US005346278A

United States Patent [19]

Dehondt

[11] Patent Number: 5,346,278

[45] Date of Patent: Sep. 13, 1994

[54] NON-SLIP CUSHION

[76] Inventor: Jacques H. Dehondt, 4513 Cove Trail, Anderson, S.C. 29621

[21] Appl. No.: 112,211

[22] Filed: Aug. 26, 1993

Related U.S. Application Data

[63] Continuation of Ser. No. 893,560, Jun. 3, 1992, abandoned, which is a continuation of Ser. No. 728,356, Jul. 11, 1991, abandoned.

[51] Int. Cl.[5] ..... A47C 27/00

[52] U.S. Cl. ..... 297/219.1; 297/219.12

[58] Field of Search ..... 297/218, 219.1, 219.12; 428/131, 134, 137; 128/96

[56] References Cited

U.S. PATENT DOCUMENTS

| | | | |
|---|---|---|---|
| 770,973 | 9/1904 | Lippert | 297/219 |
| 2,356,948 | 8/1944 | Reed | 297/219 X |
| 2,649,143 | 8/1953 | Simon et al. | 297/219 X |
| 2,794,757 | 6/1957 | Bright | 297/218 |
| 3,371,957 | 3/1968 | Cook | 297/219 |
| 3,504,941 | 4/1970 | Gerard | 297/219 |
| 3,642,967 | 2/1972 | Doll | 428/134 X |
| 3,649,430 | 3/1972 | Lewis et al. | 428/134 X |
| 3,666,609 | 5/1972 | Kalwaites et al. | 428/134 |
| 3,916,447 | 11/1975 | Thompson | 297/219 X |
| 4,507,343 | 3/1985 | Yabu | 428/96 X |
| 4,623,573 | 11/1986 | Katz | 428/131 X |
| 4,944,992 | 7/1990 | Yoneshige et al. | 297/219 X |
| 5,015,037 | 5/1991 | Giblin et al. | 297/219 X |
| 5,045,375 | 9/1991 | Davis et al. | 428/96 |
| 5,130,187 | 7/1992 | Eberhardt | 428/96 X |

FOREIGN PATENT DOCUMENTS

| | | | |
|---|---|---|---|
| 2851348 | 6/1979 | Fed. Rep. of Germany | 297/219 |
| 2203273 | 5/1974 | France | 297/219 |

*Primary Examiner*—Jose V. Chen
*Attorney, Agent, or Firm*—Ralph Bailey

[57] ABSTRACT

A non-slip high chair cushion, having globules C of rubbery polymeric material deposited on a scrim fabric A as by dipping same in a plastic foam material, prevents an infant from sliding forwardly out of the high chair.

7 Claims, 2 Drawing Sheets

NON-SLIP CUSHION

This application is a continuation of patent application Ser. No. 07/893,560, filed Jun. 3, 1992, now abandoned.

BACKGROUND OF THE INVENTION

This invention relates to a non-slip cushion for high chairs which prevents an infant from sliding out of the high chair and which additionally restricts squirming of the infant.

As has been well recognized in the art, the infant must assume a substantially erect posture when seated in a conventional high chair to avoid sliding forwardly or outwardly therefrom. The infant will not maintain the desired position if allowed to squirm. Various devices have been proposed to improve the posture of the infant or to otherwise prevent the infant from sliding out of the high chair. For instance, U.S. Pat. No. 4,712,833 illustrates a wedge-shaped cushion to prevent forward sliding of the infant. Also, U.S. Pat. No. 3,311,410 illustrates an anti-slip bar having a convex upper side to prevent forward sliding of an infant from a high chair.

Accordingly, it is an important object of the present invention to provide a non-slip high chair cushion which provides sufficient frictional force both between the cushion and the high chair seat and between the cushion and the bottom of the baby to prevent the baby from falling from the high chair.

Another important object of the invention is to provide a non-slip high chair cushion which covers a substantial portion of the upper surface of the high chair seat so as to provide a significant surface area of frictional resistance to movement of the cushion with respect to the high chair seat.

Another important object of the invention is to provide a non-slip high chair cushion having a scrim material which possesses resistance to deformation at right angles to each other.

SUMMARY OF THE INVENTION

It has been found that a non-slip high chair cushion may be provided which prevents an infant from sliding forwardly out of the high chair and which inhibits lateral squirming of the infant. The cushion includes a fabric constructed of a scrim material so as to possess substantial resistance to deformation in two directions at right angles to each other. The scrim forms openings in the fabric, which, in the preferred embodiment, are in a checkerboard pattern. Globules of rubbery polymeric material are deposited on the scrim as by dipping the scrim in a plastic foam material.

Cushions constructed in accordance with the invention are flexible so as to lie flat on the high chair seat. Said rubber polymeric material enables the cushion to maintain a high coefficient of friction both between the cushion and the high chair seat and between the cushion and the bottom of the baby to prevent the baby from falling from the high chair.

In a preferred embodiment, the cushion includes a binder in the form of a border portion which extends to form ties at the rear corners of the cushion for securement to a high chair back. The frictional force provided by the cushion aids in resisting horizontal forces which tend to move the cushion with respect to the high chair seat.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
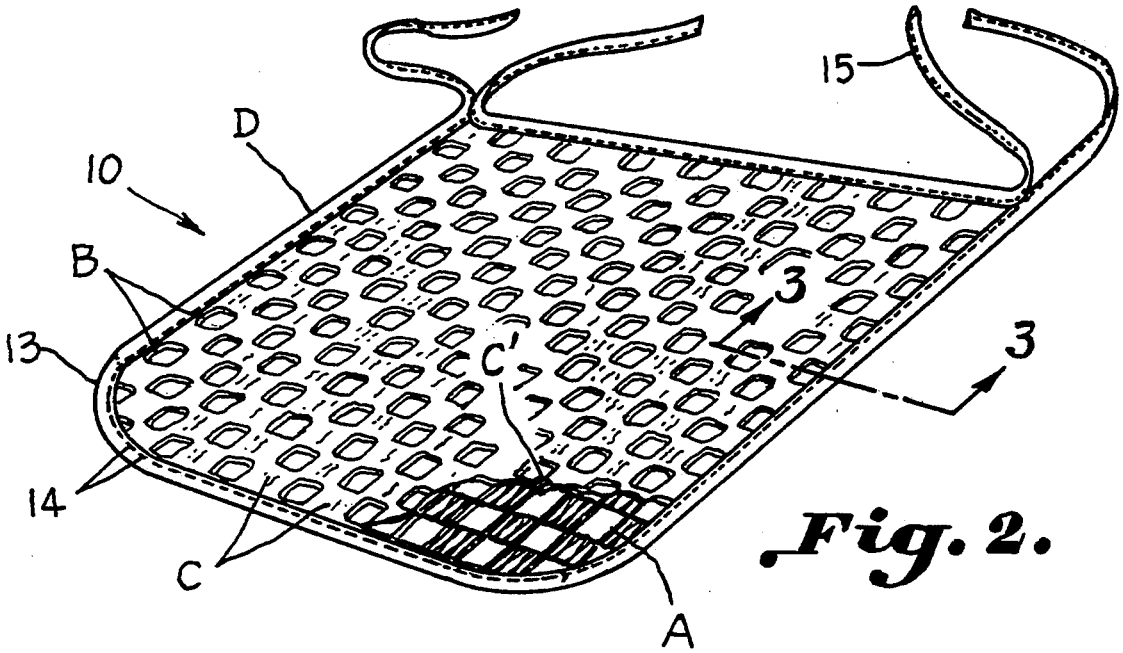
FIG. 2 is a perspective view of a high chair non-slip cushion in accordance with the preferred embodiment of the invention, with polymeric coating partially broken away to reveal underlying scrim material.

The drawings illustrate a high chair non-slip cushion comprising a fabric made of scrim material A so as to possess substantial resistance to deformation in two directions at right angles to each other. The fabric has openings or enlarged open gaps B therein formed by the scrim, as shown in FIG. 2. Globules C of a rubbery polymeric material are deposited on the scrim as by dipping the scrim in a plastic foam material. A border portion D defines the shape of the cushion. The cushion is sufficiently flexible so as to lie flat clinging to a smooth high chair seat and to maintain a high coefficient of friction between the high chair seat and an infant. The infant is thereby protected against sliding or skidding out of a high chair.

Figure 1:
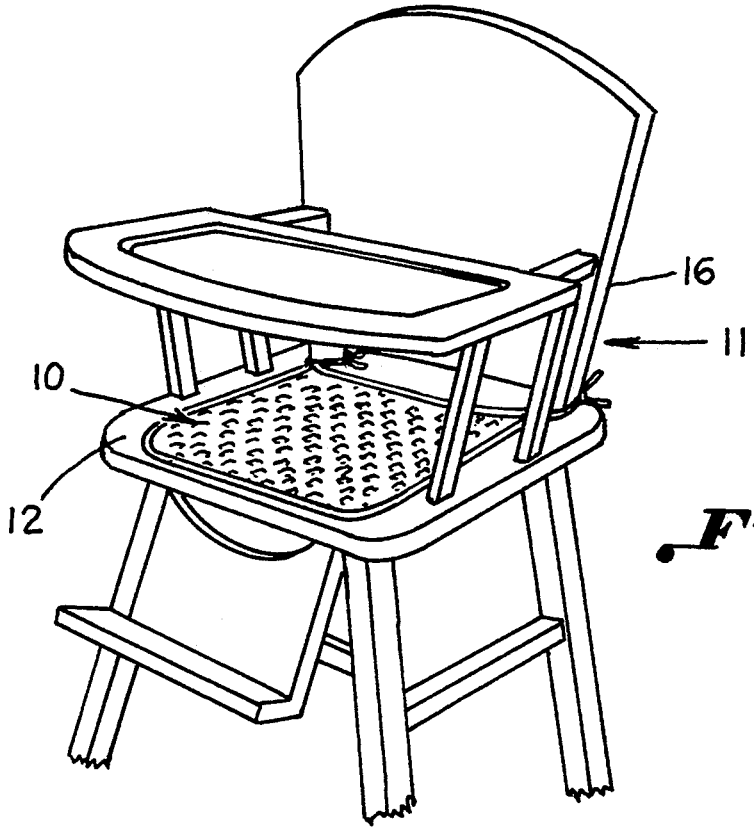
FIG. 1 is a perspective view illustrating a high chair non-slip cushion constructed in accordance with a preferred embodiment of the invention positioned upon the seat of a high chair.

Referring to FIGS. 1 and 2, the preferred embodiment of the high chair non-slip cushion is shown generally at 10 positioned upon the seat 12 of a high chair 11. The shape of the cushion 10 is defined by a binder 13 which in this instance forms a border portion D. Although the shape is shown in the figures as being substantially square, the cushion 10 may assume any shape which best cooperates with the shape of the high chair seat 12.

Figure 3:
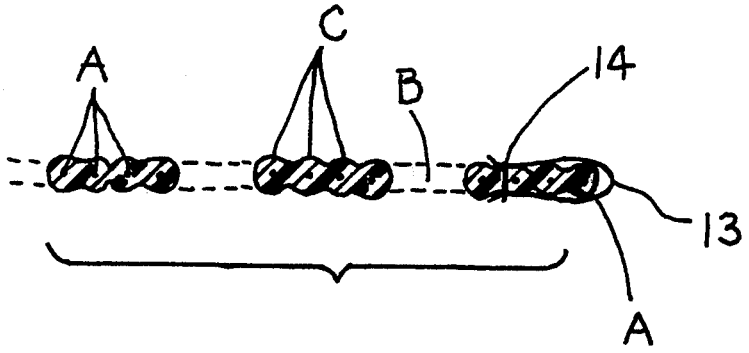
FIG. 3 is a partial sectional elevation view taken along line 3—3 of FIG. 2, detailing the scrim material embedded within the polymeric material and a portion of a binder enclosing an exterior edge of the cushion.
Figure 4:
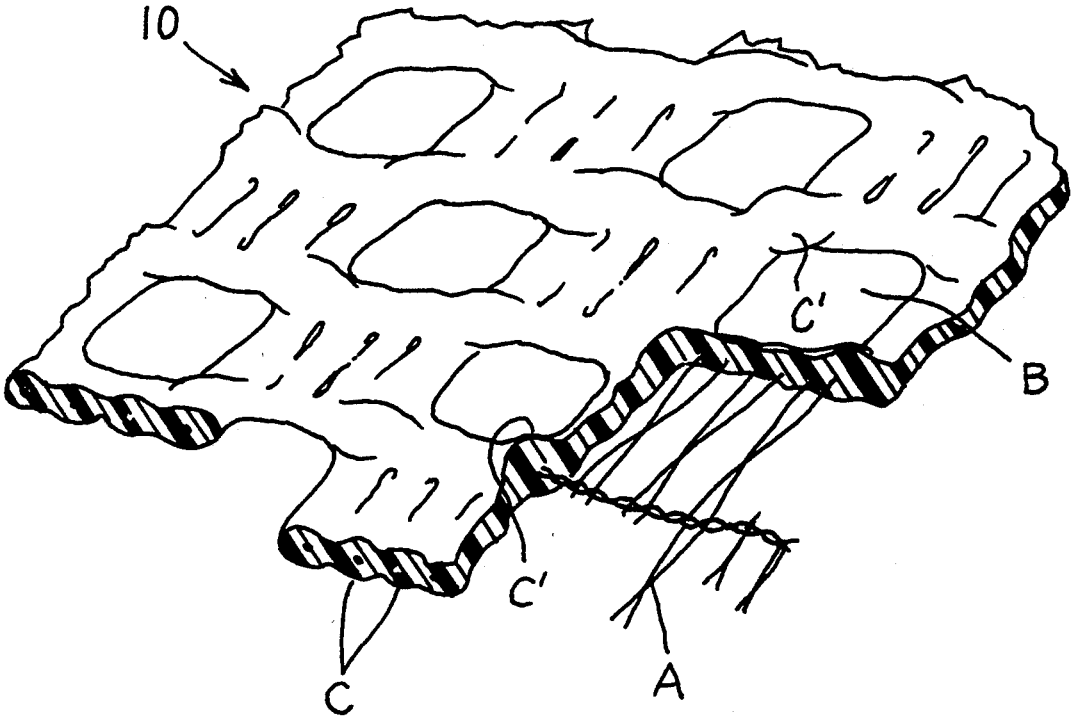
FIG. 4 is an enlarged perspective view further detailing the scrim material and related cushion construction.

Referring to FIGS. 2 and 3, the preferred embodiment includes a binder 13 secured about the edges of the scrim A as by stitches 14. Additionally, the binder 13 extends at rear corners of cushion 10 to form ties 15 for securement to high chair back 16.

The high chair non-slip cushion 10 is formed by dipping scrim material A into a plastic foam material. This results in the formation of globules C of rubbery polymeric material, preferably polyvinyl chloride, distributed randomly in both directions about the yarn forming the scrim fabric A, as illustrated in FIGS. 1 and 2. The globules C are more pronounced at intersections of the yarn forming the scrim fabric as at C'. The fabric may contain added scrim in openings or enlarged open gaps B forming a checkerboard pattern over the fabric.

Suitable cushion material is provided by American Non-Slip Products, Inc., 2924-A Amwiler Road, Doraville, Ga. 30360 for use under rugs to prevent slipping. A preferred product is sold under the trademark MEGA-LOCK as a non-slip rug pad. This fabric is constructed from 150 denier polyester yarn and in dipped in liquid polyvinyl chloride which has been foamed in a standard foamer prior to dipping.

Because globules C possess a relatively high coefficient of friction as compared to the scrim and other yarn forming cushion covers, and because they reside on both top and bottom surfaces of cushion 10, a high coefficient of friction is provided both between the cushion and the high chair seat and between the cushion and the bottom of the baby, thereby preventing the baby from falling from the high chair. Moreover, the flat configuration of cushion 10 provides a significant surface area of contact; thus, the frictional forces generated by each globule C combine to constitute a resultant frictional force, which provides considerable resistance to movement of the cushion 10 with respect to seat 12 in any direction. Such a configuration likewise inhibits lateral squirming of an infant upon seat 12.

While a preferred embodiment of the invention has been described using specific terms, such description is for illustrative purposes only, and it is to be understood that changes and variations may be made without departing from the spirit or scope of the following claims.

What is claimed is:

1. A non-slip cushion for a seat comprising a single layer of scrim fabric having spaced fibers extending longitudinally and transversely so as to possess substantial resistance to stretching in directions at right angles to each other;

said scrim fabric having enlarged substantially rectangular openings therein formed by said longitudinally and transversely extending spaced fibers;

globules of a rubbery polymeric material deposited on both sides of said scrim fabric providing each side thereof with a frictional coating of plastic foam material;

said coated scrim fabric being configured to conform to the shape of a seat and positioned thereon to provide a cushion for a user of the seat;

said cushion being breathable and flexible so as to lie flat against the seat surface under the weight of a user and maintaining a high coefficient of friction between one side of said cushion and said seat, and on the other side between said cushion and a user sitting on said cushion;

said single layer of fabric being oriented in said cushion so that said scrim is in respective transverse and longitudinal alignment on said seat; and, said scrim fabric having a peripheral portion providing a border, edge including a binder, said binder being extended to form ties at one end of said cushion for securement to a chair back; whereby the user is protected against sliding and skidding off the seat and the cushion is protected against stretching under the weight of the user.

2. The structure set forth in claim 1 wherein said scrim fabric fiber forms enlarged openings in said fabric arranged in a checkerboard pattern.

3. The structure set forth in claim 1 wherein said globules are spaced randomly about said scrim.

4. The structure set forth in claim 3 wherein said globules are foamed polyvinyl chloride.

5. The structure set forth in claim 1 wherein said seat is a smooth high chair seat of a high chair.

6. A method of using a non-slip cushion material for use as a supporting surface comprising the steps of:

using a single-layer of a non-slip fabric made of scrim fabric having spaced fibers extending longitudinally and transversely so as to possess substantial resistance to stretching in directions at right angles to each other and providing enlarged openings therein, and having globules of rubbery polymeric foam material coated on both sides of said scrim so as to be flexible and breathable and to provide each side of said fabric with a friction surface;

orienting said fabric so that said scrim fibers are disposed in transverse and longitudinal alignment on a supporting surface;

cutting said fabric to form a cushion having a border portion defined by a peripheral edge and configured to conform to the supporting surface of a seat upon which the cushion is to be used, said border portion including a binder secured by stitches about the peripheral edge of the cushion, said binder being extended to form ties at one end of said cushion;

placing said cushion on the supporting surface of a chair; and tying the ties to the back of the chair, whereby a person seated on said cushion is protected against sliding and skidding off the supporting surface.

7. A method of using a non-slip cushion material for use on a supporting surface comprising the steps of:

using a single layer of a non-slip fabric made of scrim material spaced longitudinally and transversely having enlarged open gaps therein formed in a generally checkerboard pattern by said scrim, possessing substantial resistance to deformation in two directions at right angles to each other;

providing enlarged open gaps in said fabric formed by said scrim and having globules of rubbery plastic foam material coated on said scrim so as to be flexible and breathable and to provide a first non-slip surface across one side of said fabric overlying said supporting surface, and a second non-slip surface across the other side of said fabric;

orienting said fabric so that said scrim is disposed in transverse and longitudinal alignment on said supporting surface;

forming a border about edges of said fabric to define a shape of said cushion conforming to a supporting surface upon said cushion used;

orienting said border for transverse and longitudinal alignment with said supporting surface and for transverse and longitudinal alignment with said generally checkerboard pattern formed by said scrim; and placing said fabric on said supporting surface;

whereby said cushion is secured to said supporting surface, and a person seated on said fabric is protected against sliding or skidding off of said supporting surface, and the cushion is protected against stretching under the weight of the user.

* * * * *